US009759082B2

(12) United States Patent
Thomas et al.

(10) Patent No.: US 9,759,082 B2
(45) Date of Patent: Sep. 12, 2017

(54) TURBINE BLADE TRACK ASSEMBLY

(71) Applicant: Rolls-Royce Corporation, Indianapolis, IN (US)

(72) Inventors: David J. Thomas, Brownsburg, IN (US); Richard C. Uskert, Timonium, MD (US)

(73) Assignee: Rolls-Royce Corporation, Indianapolis, IN (US)

( * ) Notice: Subject to any disclaimer, the term of this patent is extended or adjusted under 35 U.S.C. 154(b) by 795 days.

(21) Appl. No.: 14/145,202

(22) Filed: Dec. 31, 2013

(65) Prior Publication Data

US 2014/0271145 A1 Sep. 18, 2014

Related U.S. Application Data

(60) Provisional application No. 61/778,286, filed on Mar. 12, 2013.

(51) Int. Cl.

| | |
|---|---|
| ***F01D 11/08*** | (2006.01) |
| ***F01D 11/12*** | (2006.01) |
| ***F01D 11/18*** | (2006.01) |
| ***F01D 11/24*** | (2006.01) |
| ***F01D 25/24*** | (2006.01) |

(52) U.S. Cl.

CPC ..... *F01D 11/08* (2013.01); *F01D 11/12* (2013.01); *F01D 11/18* (2013.01); *F01D 11/24* (2013.01); *F01D 25/246* (2013.01); *F05D 2300/6033* (2013.01)

(58) Field of Classification Search

CPC ..... F01D 25/246

See application file for complete search history.

(56) References Cited

U.S. PATENT DOCUMENTS

| | | | | |
|---|---|---|---|---|
| 4,087,199 | A * | 5/1978 | Hemsworth | F01D 11/08 415/173.3 |
| 4,512,159 | A | 4/1985 | Memmen | |
| 4,728,257 | A | 3/1988 | Handschuh | |
| 5,074,752 | A | 12/1991 | Murphy et al. | |
| 6,406,256 | B1 | 6/2002 | Marx | |
| 6,648,597 | B1 | 11/2003 | Widrig et al. | |
| 6,702,550 | B2 | 3/2004 | Darkins et al. | |
| 6,733,235 | B2 | 5/2004 | Alford et al. | |

(Continued)

FOREIGN PATENT DOCUMENTS

| | | |
|---|---|---|
| EP | 1076161 A2 | 2/2001 |
| EP | 1944474 A2 | 7/2008 |

(Continued)

OTHER PUBLICATIONS

International Search Report for PCT International Application Serial No. PCT/US2013/078462, dated Mar. 20, 2014, (12 pages).

*Primary Examiner* — Woody Lee. Jr.

(74) *Attorney, Agent, or Firm* — Barnes & Thornburg LLP

(57) ABSTRACT

A gas turbine engine is disclosed with a turbine section having at least one turbine rotor with a plurality of turbine blades, a plurality of blade tracks positioned circumferentially around the turbine blades, at least one dovetail shaped connecting member extending radially outward from each blade track, and a hanger connected to a structural member of the gas turbine engine and configured to releasably couple with the at least one dovetail shaped connecting member of a corresponding blade track.

20 Claims, 6 Drawing Sheets

(56) References Cited

U.S. PATENT DOCUMENTS

| | | | | |
|---|---|---|---|---|
| 6,758,653 | B2 | 7/2004 | Morrison | |
| 6,896,483 | B2 | 5/2005 | Dierksmeier et al. | |
| 7,052,235 | B2 * | 5/2006 | Alford | F01D 9/04 415/173.1 |
| 7,117,983 | B2 | 10/2006 | Good et al. | |
| 7,278,820 | B2 | 10/2007 | Keller | |
| 7,284,958 | B2 | 10/2007 | Dundas et al. | |
| 7,306,826 | B2 | 12/2007 | Subramanian et al. | |
| 7,329,101 | B2 | 2/2008 | Carper et al. | |
| 7,488,157 | B2 | 2/2009 | Marini et al. | |
| 7,510,379 | B2 | 3/2009 | Marusko et al. | |
| 7,579,094 | B2 | 8/2009 | Subramanian et al. | |
| 7,686,577 | B2 | 3/2010 | Morrison et al. | |
| 7,726,936 | B2 | 6/2010 | Keller et al. | |
| 7,754,126 | B2 | 7/2010 | Subramanian et al. | |
| 8,128,350 | B2 * | 3/2012 | Schiavo | F01D 11/08 415/173.1 |
| 8,246,299 | B2 | 8/2012 | Razzell et al. | |
| 8,303,245 | B2 | 11/2012 | Foster et al. | |
| 9,267,388 | B2 * | 2/2016 | Mizokami | F01D 9/04 |
| 2003/0185674 | A1 * | 10/2003 | Alford | F01D 11/08 415/173.1 |
| 2008/0159850 | A1 | 7/2008 | Tholen et al. | |
| 2009/0169368 | A1 | 7/2009 | Schlichting et al. | |
| 2009/0257875 | A1 | 10/2009 | McCaffrey et al. | |
| 2010/0172760 | A1 | 7/2010 | Ammann | |
| 2011/0171018 | A1 | 7/2011 | Garcia-Crespo | |
| 2011/0318171 | A1 | 12/2011 | Albers et al. | |
| 2012/0082540 | A1 | 4/2012 | Dziech et al. | |
| 2012/0156029 | A1 | 6/2012 | Karafillis et al. | |

FOREIGN PATENT DOCUMENTS

| | | | | |
|---|---|---|---|---|
| EP | 2034132 | A2 | 3/2009 | |
| EP | 1350927 | A2 | 10/2013 | |
| GB | 1487064 | A | 9/1977 | |
| GB | 2484188 | A | 4/2012 | |
| JP | 3026346 | U | 3/1991 | |
| JP | H110205305 | A | 8/1998 | |
| WO | WO 2012002528 | A1 * | 1/2012 | F01D 9/04 |

* cited by examiner

TURBINE BLADE TRACK ASSEMBLY

CROSS REFERENCE TO RELATED APPLICATIONS

This application claims priority to and the benefit U.S. Provisional Patent Application No. 61/778,286, filed on Mar. 12, 2013, the disclosure of which is now expressly incorporated herein by reference.

TECHNICAL FIELD

The present invention relates to a blade track assembly for a gas turbine engine, and more particularly to a blade track assembly having low stress attachment configurations.

BACKGROUND

Turbine blade tracks, sometimes ailed turbine shroud seals are designed to provide a circumferential flow path around a turbine rotor. The inner surface of the blade track is typically positioned as close to the tips of the turbine rotor blades as possible without actually engaging during operation. The clearance between the tip of the blade and the blade track is minimized so as to provide higher operating efficiencies as understood by those skilled in the art. The inner surface of the blade tracks operate at the temperature of the hot exhaust gases flowing therethrough which can be well in excess of 2000° F. In addition to high temperatures, the gas path also operates at elevated pressures relative to ambient conditions. The blade tracks are supported through connections to static structure radially outward and opposite the gas path side of the inner surface. The blade track connections can be placed under high stress due to high thermal and high pressure gradients across the blade track and over time a mechanical failure can occur. Some existing blade track systems have various shortcomings, drawbacks, and disadvantages relative to certain applications. Accordingly, there remains a need for further contributions in this area of technology.

SUMMARY

One embodiment of the present invention is a unique turbine blade track configuration and assembly. Other embodiments include unique apparatuses, systems, devices, hardware, methods, and combinations for gas turbine engine power systems. Further embodiments, forms, features, aspects, benefits, and advantages of the present application shall become apparent from the following description and drawings.

BRIEF DESCRIPTION OF THE FIGURES

The description herein makes reference to the accompanying drawings wherein like reference numerals refer to like parts throughout the several views, and wherein.

DETAILED DESCRIPTION OF REPRESENTATIVE EMBODIMENTS

Figure 1:
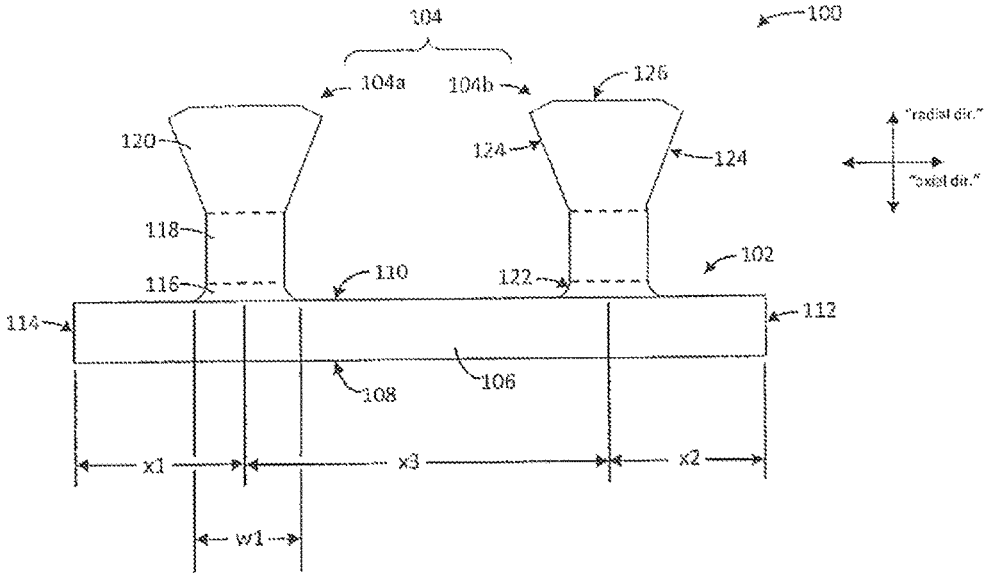
FIG. 1 is an elevational view of one embodiment of a blade track, as shown somewhat schematically in a circumferential viewing direction.

For the purposes of promoting an understanding of the principles of the invention, reference will now be made to the embodiments illustrated in the drawings and specific language will be used to describe the same. It will nevertheless be understood that no limitation of the scope of the invention is hereby intended. Any alterations and further modifications in the described embodiments, and any further applications of the principles of the invention as described herein are contemplated as would normally occur to one skilled in the art to which the invention relates.

Exemplary embodiments of the disclosure are described herein with reference to FIGS. 1-13 which are schematic illustrations of idealized embodiments and intermediate structures. As such, variations in the shapes and sizes of the structures illustrated in FIGS. 1-13 due to, for example, manufacturing techniques and/or tolerances, are contemplated. Thus, the structures described herein with reference to FIGS. 1-13 are not limited to the particular sizes and shapes of the illustrated structures, elements and features, but instead include deviations in the shapes and sizes that result, for example, from manufacturing techniques and/or tolerances. Thus, the structures, elements and features illustrated in FIGS. 1-13 are exemplary and schematical in nature, and their shapes and sizes do not necessarily illustrate the actual shapes and sizes of the structures, elements and features of the present invention, and are likewise not intended to limit the scope of the present invention.

Within a gas turbine engine, stationary shroud segments (also known as "blade track segments") are typically assembled circumferentially about an axial flow engine axis and are positioned radially outward from rotating turbine blades. A clearance between the tips of the rotating turbine blades and the juxtaposed surface of the blade tracks (also known as "shroud clearance" or "blade clearance") is often kept to a minimum distance so as to enhance the operating efficiency of the gas turbine engine.

Referring to FIG. 1, shown therein is a blade track 100 according to one embodiment of the present invention. The blade track 100 generally includes a segment portion 102 and attachment portions 104*a* and 104*b* (also generally referred to herein as "attachment portion(s) 104") extending from the segment portion 102 in a radially outward direction. In one embodiment, the attachment portions 104 can be formed separately from the segment portion 102 and subsequently coupled to the segment portion 102 by known methods and techniques. In another embodiment, and as will be described in greater detail below, the attachment portions 104 can be integrally formed with the segment portion 102 so as to define a unitary, monolithic structure. In a further embodiment, the segment portion 102 and the attachment portions 104 are provided as an integrally-formed unitary/monolithic ceramic matrix composite (CMC) structure.

The segment portion 102 generally includes a segment body 106 having a radially-facing inner surface 108, an opposite radially-facing outer surface 110, a first axially-facing surface 112, and a second axially-facing surface 114 opposite the first axially-facing surface 112. Generally, the radially-facing inner surface 108 is juxtaposed with respect to the tips of the rotary turbine blades, and is exposed to high pressures and temperatures of the gas flow path that drives the rotary turbine blades. Thus, the distance between the radially-facing inner surface 108 and the blade tips of the rotary turbine blades (not shown in the drawings) corresponds to the blade or shroud clearance. The radially-facing outer surface 110 generally faces toward the outer casing of the turbine engine and is exposed to pressures and temperatures that are typically significantly lower than those exerted onto the radially-facing inner surface 108.

The attachment portion 104*a* is structured and positioned such that a midpoint thereof is spaced apart from the second axially-facing surface 114 along the axial direction by a distance x1. Similarly, the attachment portion 104*b* is structured and positioned such that a midpoint thereof is spaced apart from the first axially-facing surface 112 along the axial direction by a distance x2. Distance x1 may be the same as or different from (i.e., greater than or less than) distance x2. In one embodiment; midpoints of the attachment portions 104*a*, 104*b* may be spaced apart from one another along the axial direction by a distance x3. Distance x3 may be the same as one or both of distances x1 and x2, or may be different from (i.e., greater than or less than) one or both of distances x1 and x2. In general the total distance (x1+x2+x3), is at least equal to the width of the tips of the corresponding turbine blades as defined by a chord length between the leading and trailing edges at the tip of the blade.

Each of the attachment portions 104*a* and 104*b* includes a transition region 116, an extension region 118, and a coupling region 120. The transition region 116 extends radially outward from the radially-facing outer surface 110 to the extension region 118 and forms a generally arcuate transition surface 122. The width w1 of the attachment portions 104*a*, 104*b* at the radially-facing outer surface 110 of the segment body 106 along the axial direction (i.e., the axial width of the transition region 116 at its widest point) may be less than one-half of the axial length of the segment body 106 (i.e., the distance separating the first and second axially-facing surfaces 112, 114). In any event, the width w1 will be designed such that the attachment portions 104 can withstand operational loads transmitted by the blade track. The extension region 118 extends radially outward from the transition region 116 to the coupling region 120, and may have a length selected to ensure an adequate blade clearance. However, in other embodiments, the extension region 118 may be omitted. In the illustrated embodiment, the coupling region 120 has a trapezoid-shaped (also referred to as a "dovetail") cross section forming pairs of axially-opposite mating surfaces 124, and an attachment termination surface 126 extending between the opposite mating surfaces 124. The axially-opposite mating surfaces 124 generally diverge away from one another along a radially outward direction (i.e., toward the attachment termination surface 126), or generally converge toward one another along a radially inward direction (i.e., toward the radially-facing outer surface 110 of the segment body 106). As will be discussed in greater detail below, the axially-opposite mating surfaces 124 of the coupling region 120 can engage with corresponding mating surfaces of a hanger to thereby secure the blade track 100 within a blade track assembly of a gas turbine engine. In the illustrated embodiment, the coupling region 120 of the attachment portion 104 can carry high loads without developing undesirably high localized stresses.

Figure 2:
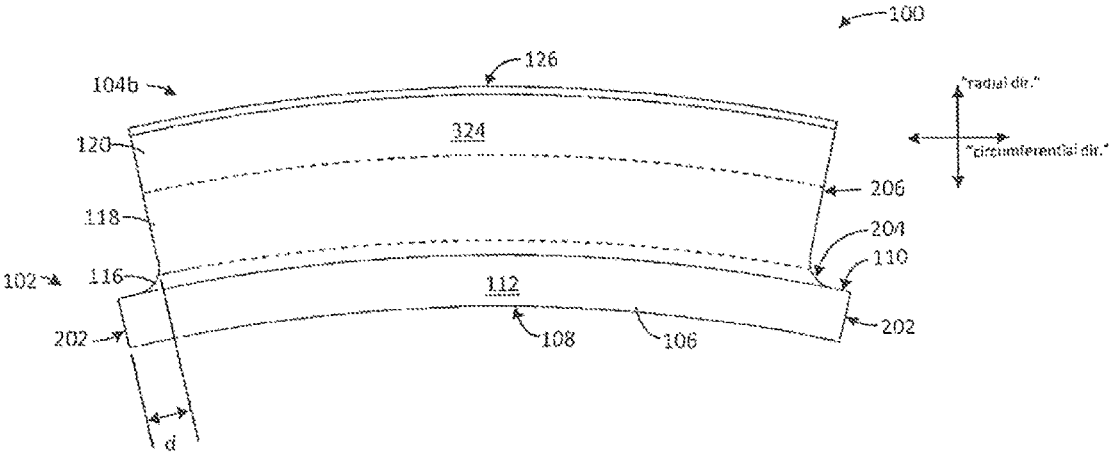
FIG. 2 is an elevational view of the blade track illustrated in FIG. 1, as shown somewhat schematically in an axial viewing direction.

Referring to FIG. 2, the segment portion 102 of the blade track 100 is structured such that the radially-facing inner surface 108 is curved in a circumferential direction to accommodate rotation of the turbine blades and to ensure that an adequate blade clearance is maintained. In one embodiment, the radially-facing inner surface 108 forms an arc-shaped surface. Additionally, the segment body 106 has a pair of opposite circumferentially-facing surfaces 202 positioned at opposite ends of the radially-facing inner surface 108. In another embodiment, each of the circumferentially-facing surfaces 202 extends from the first axially-facing surface 112 to the second axially-facing surface 114. As shown in FIG. 2, the transition region 116 of the attachment portion 104 can be structured to form a generally arcuate transition surface 204 extending from the radially-facing outer surface 110 to a circumferentially-facing surface 206 of the attachment portion 104. The attachment termination surface 126 of the attachment portions 104 can also be curved in the circumferential direction to form an arc-shaped surface corresponding to that of the radially-facing inner surface 108. Additionally, the radial length of the extension region 118 is substantially constant along the circumferential direction. Similarly, the radial length of the coupling region 120 is substantially constant along the circumferential direction. Accordingly, the axially-opposite mating surfaces 124 of the attachment portion 104 may have a generally concave form.

The circumferentially-facing surfaces 206 of the attachment portion 104 can extend across the extension region 118 and the coupling region 120. As exemplarily illustrated in FIG. 2, the opposite circumferentially-facing surfaces 206 are substantially planar. However, it should be appreciated that at least a portion of one or both of the circumferentially-facing surfaces 206 can be curved or curvilinear. In one embodiment, the circumferentially-facing surfaces 206 of the attachment portion 104 can be circumferentially spaced apart from an adjacent circumferentially-facing surface 202 of the segment body 106 along the circumferential direction by a distance d. In another embodiment, the length (unlabeled) of the attachment portions 104 at the radially-facing outer surface 110 of the segment body 106 along the circumferential direction (i.e., the circumferential length of the transition region 116 at its widest point) is greater than the width w1 of the attachment portion 104 at the radially-facing outer surface 110 of the segment body 106. With regard to the discussion of the attachment portion 104 set forth above with respect to FIG. 2, it should be appreciated that such discussion applies to both of the attachment portions 104*a* and 104*b*. However, it should be further appreciated that, in other embodiments, the attachment portions 104*a* and 104*b* can be constructed or otherwise structured differently from one another.

Figure 3:
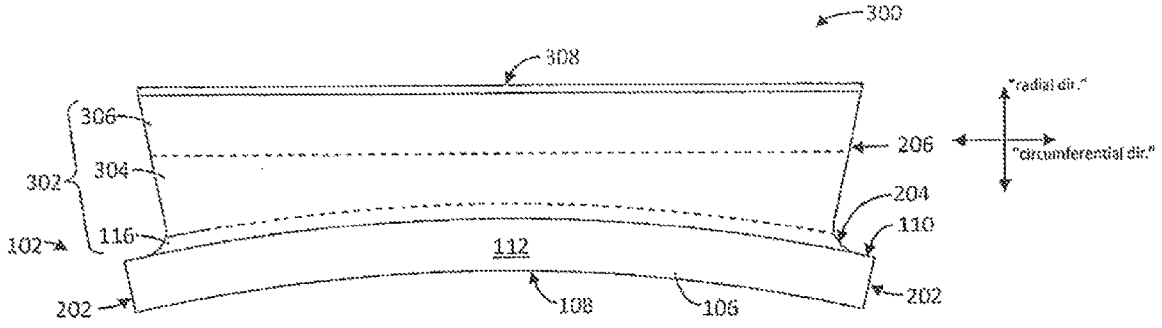
FIG. 3 is an elevational view of another embodiment of a blade track, as shown somewhat schematically in an axial viewing direction.

Referring to FIG. 3, shown therein is a blade track 300 configured in some respects similar to the blade track 100 illustrated and described above. However, the blade track 300 may include one or more attachment portions 302 that differ in certain respects relative to the attachment portions 104*a*, 104*b* of the blade track 100. As exemplarily shown in FIG. 3, the attachment portion 302 includes an extension region 304 and a coupling region 306 extending radially outward from the extension region 304 and defining a radially-facing outer surface 308. The extension region 304 is configured similar to the extension region 118 of the blade track 100. However, the radial dimension of the extension region 304 can vary in a circumferential direction. Additionally, the radially-facing outer surface 308 may be substantially planar in the circumferential direction as shown, and the radial dimension of the coupling region 306 may be substantially constant along the circumferential direction. Alternatively, the outer surface 308 may be curved in the circumferential direction similar to the configuration of the inner surface 108. Moreover, the axially-opposite mating surfaces 324 of the attachment portion 302 may have a substantially flat or planar form.

Figure 4:
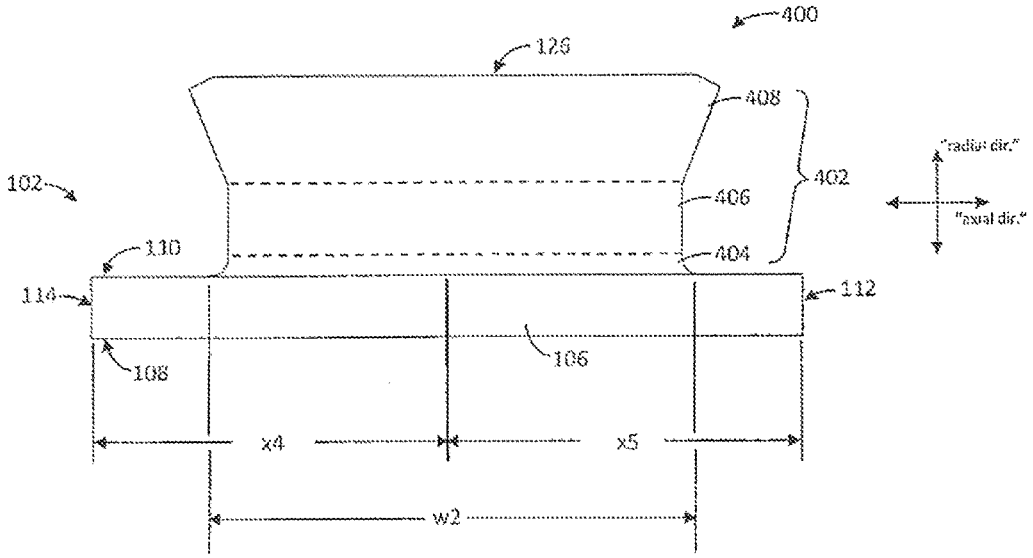
FIG. 4 is an elevational view of another embodiment of a blade track, as shown somewhat schematically in a circumferential viewing direction.

Referring now to FIG. 4, shown therein is a blade track 400 configured in some respects similar to the blade track 100 illustrated and described above. However, the blade track 400 includes a single attachment portion 402 as opposed to the pair of attachment portions 104*a*, 104*b* associated with the blade track 100. Generally, the attachment portion 402 is structured such that a midpoint thereof is spaced apart from the second axially-facing surface 114 of the segment body 106 along the axial direction by a distance x4, and is spaced apart from the first axially-facing surface 112 of the segment body 106 along the axial direction by a distance x5. Distance x4 may be the same as or different from (i.e., greater than or less than) distance x5. In general the total distance (x4+x5) is at least equal to the width of the tips of the corresponding turbine blades as defined by a chord length between the leading and trailing edges at the tip of the blade. Attachment portion 402 can include a transition region 404, an extension region 406, and a coupling region 408. Inclusion of the transition region 404 provides the attachment portion 402 with a width w2 at the radially-facing outer surface 110 of the segment body 106 along the axial direction. In one embodiment, width w2 is greater than one-half the axial dimension of the segment body 106 (i.e., the axial dimension from the first axially-facing surface 112 to the second axially-facing surface 114). Width w2 can be greater than, equal to or less than the dimension of attachment portion 402 at the radially-facing outer surface 110 of the segment body 106 along the circumferential direction (i.e., the circumferential length of the transition region 404 at its widest point). It should also be appreciated that the blade track 400 may include one or more other attachment portions, such as attachment portion 104, 302, 402 or the like.

Figure 5:
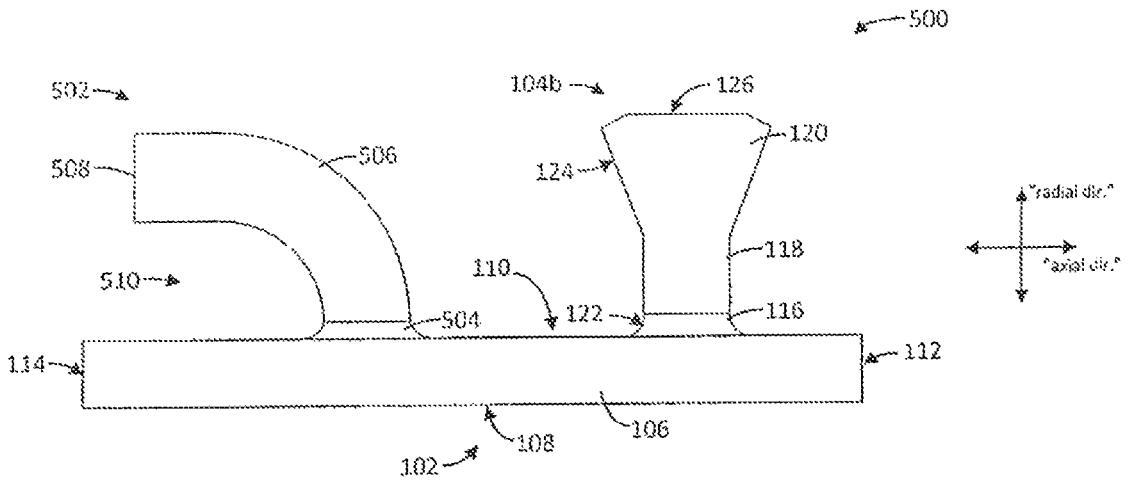
FIG. 5 is an elevational view of another embodiment of a blade track, as shown somewhat schematically in a circumferential viewing direction.

Referring to FIG. 5, shown therein is a blade track 508 configured in some respects similar to the blade track 100 illustrated and described above. However, the blade track 500 includes an attachment portion 502 in addition to the attachment portion 104*b*. It should be appreciated, however, that one or more other attachment portions (i.e., including attachment portions 302 or 402) may be provided to replace or supplement attachment portion 104*b* and/or attachment portion 502. In the illustrated embodiment, the attachment portion 502 includes a transition region 504 and a side rail region 506 having a rail end 508. The transition region 504 can be provided as discussed above with respect to any of the transition regions 116 or 404. In the illustrated embodiment, the side rail region 506 extends both radially outward from the radially-facing outer surface 110 and axially toward the second axially-facing surface 114 such that the rail end 588 faces the same direction as the second axially-facing surface 114. However, in another embodiment, the side rail region 506 may extend such that the rail end 508 faces the same direction as the first axially-facing surface 112. Constructed as exemplarily described above, the attachment portion 502 is structured to slidably engage (i.e., along the axial direction) a tab, bracket or stub of a hanger to help secure the blade track 500 within a blade track assembly of a gas turbine engine. By providing the attachment portion 502, differences in thermal expansion characteristics between the blade track 500 (a CMC component) and a hanger (typically a metal component) can be accommodated to eliminate or otherwise reduce stresses arising from the differential expansion/contraction of the hanger relative to the blade track 500.

As mentioned above, the segment portion 102 and the attachment portions described herein can be provided as an integrally-formed ceramic matrix composite (CMC) structure. In one embodiment, such a CMC structure may be formed by providing a preform structure and providing a ceramic matrix material (i.e., aluminum oxide, zirconium oxide, silicon oxide, silicon carbide, or the like or a combination thereof) which, for example, infiltrates the preform structure. Generally, the preform structure includes a reinforcement material (e.g. woven or unwoven fibers, whiskers, or the like, formed of carbon, silicon oxide, silicon carbide, aluminum oxide, aluminum nitride, mullite, titanium boride, zirconium oxide, or the like or a combination thereof). The ceramic matrix material may be provided by any suitable process such as chemical vapor deposition, chemical vapor infiltration, dipping, spraying, electroplating, or the like or a combination thereof.

Figure 6:
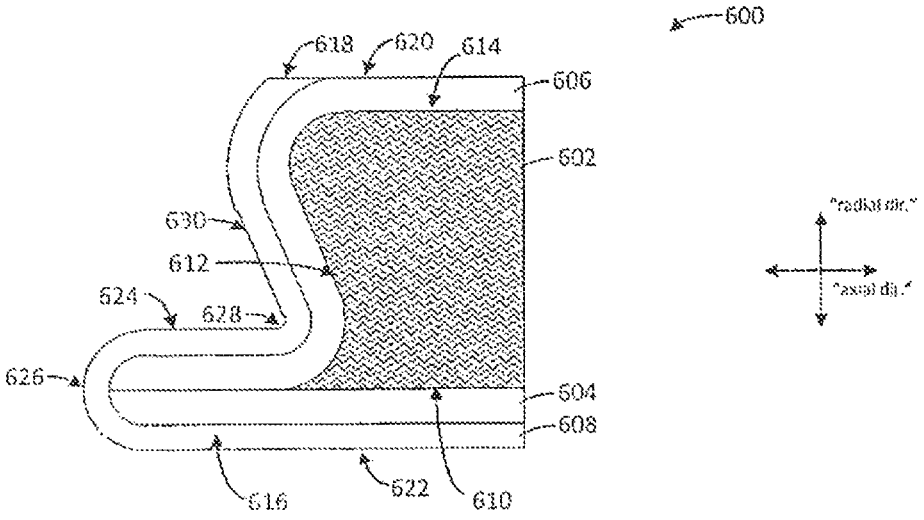
FIG. 6 is an elevational view of one embodiment of a preform structure used in the formation of a blade track, as shown somewhat schematically in a circumferential viewing direction.

Referring to FIG. 6, a preform structure 600 includes a preform core 602 and a plurality of reinforcement wraps such as first reinforcement wrap 604, second reinforcement wrap 606 and third reinforcement wrap 608. Because FIG. 6 only partially illustrates the preform structure 600 (i.e., illustrating one axial end of the preform structure 600), it should be appreciated that the preform structure 600 may extend along the axial direction any desired length. It should also be appreciated that the structure of the opposite axial end of the preform structure 600 may be the same as or different from the axial end of the preform structure 600 illustrated in FIG. 6.

In one embodiment, as will be discussed in greater detail below, the preform core 602 may include reinforcement material (i.e., provided as any suitable arrangement of woven or unwoven fibers, whiskers, or the like, formed of one or more materials such as carbon, silicon oxide, silicon carbide, aluminum oxide, aluminum nitride, mullite, titanium boride, zirconium oxide, or the like or a combination thereof). In another embodiment, the preform core 602 may be provided as a monolithic piece formed from a material such as silicon carbide. Each reinforcement wrap may be formed of one or more plies of reinforcement material. In one embodiment, each reinforcement wrap is formed of four plies of reinforcement material. In another embodiment, the number of plies of reinforcement material in one or more of the first, second and third reinforcement wraps 604, 606 and 608 may be the same as or different from the number of plies of reinforcement material in any other of the first, second and third reinforcement wraps 604, 606 and 608. In one embodiment, the reinforcement material included in one or more of the first, second and third reinforcement wraps 604, 606 and 608 may be the same as or different from the reinforcement material in any other of the first, second and third reinforcement wraps 604, 606 and 608. In another embodiment, the orientation of one or more plies of reinforcement material in one or more of the first, second and third reinforcement wraps 604, 606 and 608 may be the same as or different from the orientation of one or more plies of reinforcement material in any other of the first, second and third reinforcement wraps 604, 606 and 608.

The first reinforcement wrap 604 is disposed on a radially-facing inner surface 610 of the preform core 602, the second reinforcement wrap 606 is disposed on a second axially-facing surface 612 and a radially-facing outer surface 614 of the preform core 602, and the third reinforcement wrap 608 is disposed on the first and second reinforcement wraps 604 and 606. In one embodiment, the first and second reinforcement wraps 604 and 606 extend axially beyond the second axially-facing surface 612 of the preform core 602 to form a rim portion 616. The third reinforcement wrap 608 may be disposed on the lower, side and upper surface of the rim 616 to thereby surround the rim 616. In the illustrated embodiment, the third reinforcement wrap 608 is provided such that an edge 618 of the third reinforcement wrap 608 is substantially coplanar with preform termination surface 620 of the second reinforcement wrap 606. In other embodiments, the third reinforcement wrap 608 can be provided such that the edge 618 is recessed below the preform termination surface 620, or may alternatively be provided such that the edge 618 is positioned beyond the preform termination surface 620.

Constructed as described above, the exterior surfaces of the preform structure 600 include the preform termination surface 620, a radially-facing inner surface 622, a radially-facing outer surface 624, a second axially-facing surface 626, a transition surface 628, and an inclined surface 630. Upon providing the ceramic matrix material to infiltrate the preform structure 600, the attachment termination surface 126, radially-facing inner surface 108, radially-facing outer surface 110, second axially-facing surface 114, transition surface 122 and mating surface 124 can be formed to generally correspond to the preform termination surface 620, radially-facing inner surface 622, radially-facing outer surface 624, second axially-facing surface 626, transition surface 628 and inclined surface 630.

In one embodiment, the preform structure 600 may be formed by providing the preform core 602, disposing the radially-facing inner surface 610 of the preform core 602 on the first reinforcement wrap 604, and disposing the second reinforcement wrap 606 on the first reinforcement wrap 604 and over the axially rearward and radially-facing outer surfaces 612 and 614 of the preform core 602. The resulting structure can then be impregnated with a material such as a wax, a polymer, or the like, and optionally machined as desired. Next, the third reinforcement wrap 608 may be disposed on the first and second reinforcement wraps 604 and 606 and around the rim 616. The resulting structure can then be subjected to heat so as to melt, burn or otherwise remove any wax, polymer or the like, from the preform core 602 and the first and second reinforcement wraps 604 and 606, thereby forming the preform structure 600.

Figure 7:
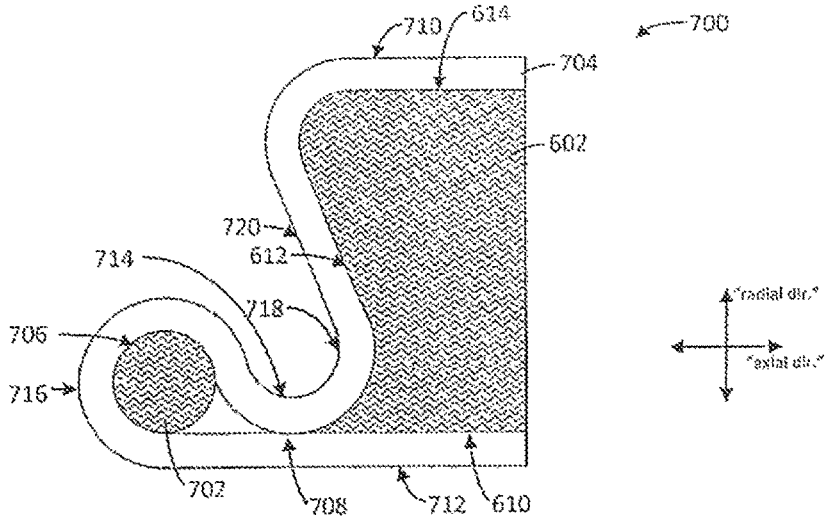
FIG. 7 is an elevational view of another embodiment of a preform structure used in the formation of a blade track, as shown somewhat schematically in a circumferential viewing direction.

Referring to FIG. 7, a preform structure 700 may be configured similar to preform structure 600 including a preform core 602, but may be further provided with a reinforcing rod 702 and a reinforcement wrap 704. The reinforcing rod 702 may be formed of any suitable material capable of, for example, imparting rigidity to the resultant blade track in the circumferential direction. In one embodiment, the reinforcing rod 702 may be formed of any suitable reinforcement material, as exemplarily discussed above. In another embodiment, the reinforcing rod 702 is formed of any suitable ceramic matrix material, as also exemplarily discussed above. In a further embodiment, the reinforcing rod 702 may be provided as a CMC structure. In the illustrated embodiment, the reinforcing rod 702 is circular in cross-section. It should be appreciated, however, that the cross-sectional shape of the reinforcing rod 702 can be any desired shape (e.g., oval, square, triangular, trapezoidal, or the like or a combination thereof).

The reinforcement wrap 704 may be provided, as exemplarily discussed above, with respect to any of the reinforcement wraps 604, 606 and 608. In the illustrated embodiment, the reinforcement wrap 704 is disposed on the radially-facing inner surface 610 of the preform core 602, an exterior surface 706 of the reinforcing rod 702, and on the axially rearward and radially-facing outer surfaces 612 and 614, respectively, of the preform core 602. As exemplarily illustrated, the reinforcement wrap 704 is folded or wrapped about the reinforcing rod 702. As a result, different regions of the reinforcement wrap 704 may contact each other at region 708.

Constructed as described above, exterior surfaces of the preform structure 700 includes a preform termination surface 710, a radially-facing inner surface 712, a radially-facing outer surface 714, a second axially-facing surface 716, a transition surface 718, and an inclined surface 720. Upon providing the ceramic matrix material to infiltrate the preform structure 700, the radially-facing inner surface 108, radially-facing outer surface 110, second axially-facing surface 114, transition surface 122 and mating surface 124 can be formed to generally correspond to the preform termination surface 710, radially-facing inner surface 712, radially-facing outer surface 714, second axially-facing surface 716, transition surface 718, and inclined surface 720.

In one embodiment, the preform structure 700 may be formed by providing the preform core 602 and the reinforcing rod 702, positioning the reinforcing rod 702 and the radially-facing inner surface 610 of the preform core 602 on the reinforcement wrap 704 and folding the reinforcement wrap 704 about the reinforcing rod 702 and over the axially rearward and radially-facing outer surfaces 612 and 614 of the preform core 602. The resulting structure can then be subjected to heat so as to melt, burn or otherwise remove any wax, polymer or the like, from the preform core 602, thereby forming the preform structure 700.

Figure 8:
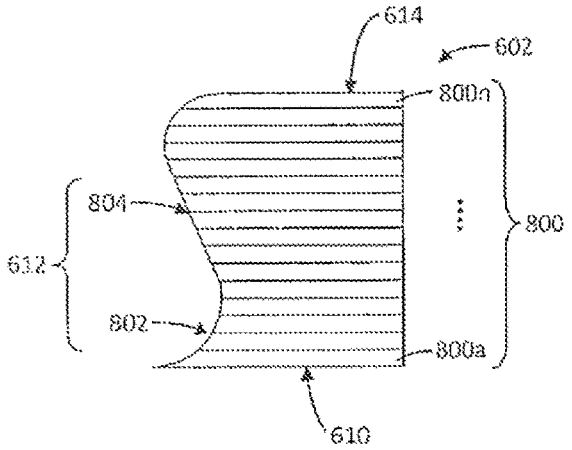
FIG. 8 is an elevational view of a core used in the formation of the preform structure illustrated in FIG. 6, as shown somewhat schematically in a circumferential viewing direction.

Referring to FIG. 8, the preform core 602 may include a plurality of plies 800*a* to 800*n* (also generically referred to herein as "plies 800" or as a "ply 800") of reinforcement material arranged in a stacked configuration. The reinforcement material may be provided as any suitable arrangement of woven or unwoven fibers, whiskers, or the like, formed of one or more materials such as carbon, silicon oxide, silicon carbide, aluminum oxide, aluminum nitride, mullite, titanium boride, zirconium oxide, or the like or a combination thereof.

As exemplarily shown in FIG. 8, the bottommost ply in the stack 800 (i.e., ply 800*a*) forms the radially-facing inner surface 610 of the preform core 602, and the topmost ply in the stack 800 (i.e., ply 800*n*) forms the radially-facing outer surface 614 of the preform core 602. In one embodiment, the plies 800 lay substantially flat so that second axially-facing surfaces of the plies 800 cooperatively form the second axially-facing surface 612 of the preform core 602. As exemplarily shown, the second axially-facing surface 612 of the preform core 602 includes a transition surface 802 and an inclined surface 804. Transitions can take the form of a noodle in some embodiments. In one embodiment, the location and shape of the transition surface 802 of the preform core 602 generally corresponds to the location and shape of the transition surface 122 of the blade track 100. In another embodiment, the location and shape of the inclined surface 804 of the preform core 602 generally corresponds to the location and shape of the mating surface 124 of the blade track 100. In one embodiment, the preform core 602 shown in FIG. 8 may be formed by arranging the plies 800 in a stack and impregnating the stack with a material such as a wax, a polymer, or the like. The resulting structure can then optionally be machined as desired.

Figure 9:
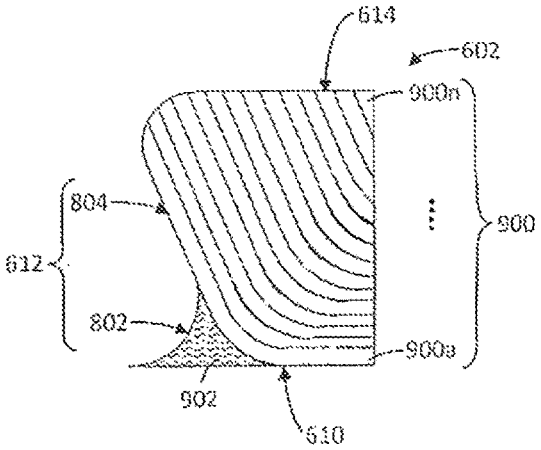
FIG. 9 is an elevational view of a core used in the formation of the preform structure illustrated in FIG. 7, as shown somewhat schematically in a circumferential viewing direction.

Referring to FIG. 9, the preform core 602 may include a plurality of plies 900*a* to 900*n* (also generically referred to herein as "plies 900" or as a "ply 900") of reinforcement material arranged in a stacked configuration, and a preform insert 902. The reinforcement material may be provided as exemplarily described with respect to the reinforcement material of the plies 800. In one embodiment, the preform insert 902 is formed of any suitable reinforcement material as exemplarily discussed above. In another embodiment, the preform insert 902 may be formed of any suitable ceramic matrix material as exemplarily discussed above. In another embodiment, the preform insert 902 may be provided as a GMC structure.

As exemplarily shown, the bottommost ply in the stack 900 (i.e., ply 900*a*) forms a portion of the radially-facing inner surface 610 of the preform core 602, and the radially-facing outer surface 614 of the preform core 602 is formed by a plurality of plies including the topmost ply in the stack 900 (i.e., ply 900*n*). In one embodiment, the plies 900 are bent to have a generally horizontal portion and an inclined portion so that when the plies 900 are stacked, the inclined surface 804 of the preform core 602 is formed substantially by only the bottommost ply 900 in the stack (i.e., by ply 900*a*). It will be appreciated, however, that the ply 900*a* and one or more other plies 900 may be structured to form the inclined surface 804. As exemplarily shown, the preform insert 902 forms a portion of the radially-facing inner surface 610 of the preform core 602, and also forms the transition surface 802 of the preform core 602. It should be appreciated, however, that the preform insert 902 may also be structured to form at least a portion of the inclined surface 804. In one embodiment, the preform core 602 shown in FIG. 9 may be formed by arranging the plies 900 in a stack, providing the preform insert 902 to abut against ply 900*a* (i.e., at an axially rearward side of the stack), and impregnating the resulting structure with a material such as a wax, a polymer, or the like, sufficient to at least temporarily couple the preform insert 902 to the stack of plies 900. The resulting structure can then be optionally machined as desired.

Figure 10:
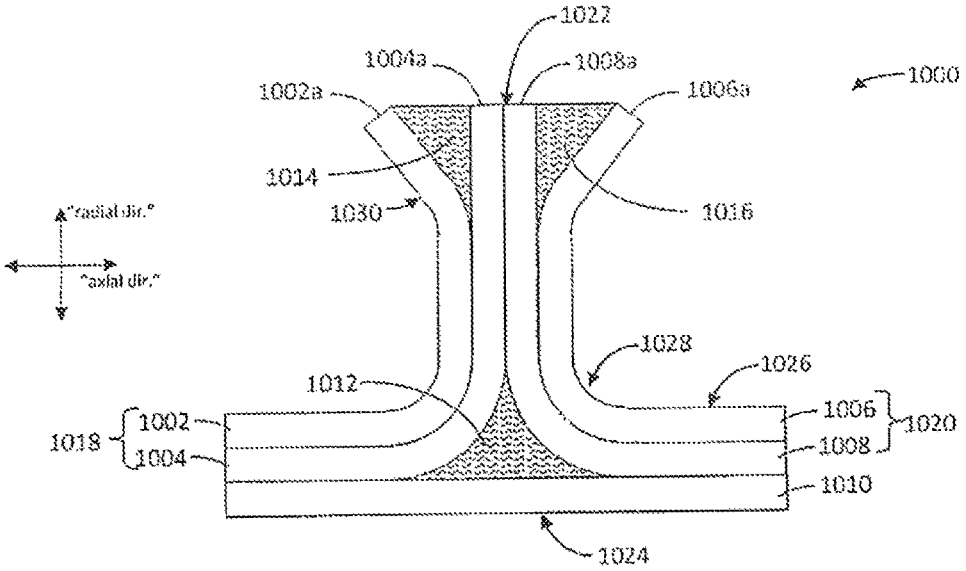
FIG. 10 is an elevational view of another embodiment of a preform structure used in the formation of a blade track, as shown somewhat schematically in a circumferential viewing direction.

Referring to FIG. 10, a preform structure, such as preform structure 1000, includes a plurality of reinforcement wraps and a plurality of preform inserts. Reinforcement wraps of the preform structure include a first reinforcement wrap 1002, a second reinforcement wrap 1004, a third reinforcement wrap 1006, a fourth reinforcement wrap 1008 and a fifth reinforcement wrap 1010. Preform inserts include a first preform insert 1012, a second preform insert 1014 and a third preform insert 1016. The reinforcement wraps 1002, 1004, 1006, 1008 and 1010 may be provided as exemplarily described above with respect to one or more of the reinforcement wraps 604, 606, 608 and 704. The preform inserts 1012, 1014 and 1016 may be provided as exemplarily described above with respect to the reinforcement insert 702.

As exemplarily illustrated, the first and second reinforcement wraps 1002 and 1004 are positioned closely adjacent to one another, but end portions of the first and second reinforcement wraps 1002 and 1004 are separated from one another such that an edge 1002*a* of the first reinforcement wrap 1002 is spaced apart from an edge 1004*a* of the second reinforcement wrap 1004. The first preform insert 1014 may be inserted between the first and second reinforcement wraps 1002 and 1004 at the edges 1002*a* and 1004*a* thereof. Similarly, the third and fourth reinforcement wraps 1006 and 1008 are positioned closely adjacent to one another, but end portions of the third and fourth reinforcement wraps 1006 and 1008 are separated from one another such that an edge 1006*a* of the third reinforcement wrap 1006 is spaced apart from an edge 1008*a* of the fourth reinforcement wrap 1008. The second preform insert 1016 may be inserted between the third and fourth reinforcement wraps 1006 and 1008 at the edges 1006*a* and 1008*a* thereof.

Taken together, the first and second reinforcement wraps 1002 and 1004 form a first preliminary preform structure 1018. Similarly, the third and fourth reinforcement wraps 1006 and 1008 form a second preliminary preform structure 1020. The second reinforcement wrap 1004 of the first preliminary preform structure 1018 is positioned closely adjacent to the fourth reinforcement wrap 1008 of the second preliminary preform structure 1020 at edges 1004*a* and 1008*a* thereof, but the second and fourth reinforcement wraps 1004 and 1008 diverge to extend axially in opposite directions. The third preform insert 1012 may be inserted between the first and second preliminary preform structures 1018 and 1020 at the location where the second and fourth reinforcement wraps 1004 and 1008 diverge. Finally, the fifth reinforcement wrap 1010 may be positioned closely adjacent to the second and fourth reinforcement wraps 1004 and 1008 such that the third preform insert 1012 is trapped in the radial and axial directions between the second, fourth and fifth reinforcement wraps 1004, 1008 and 1010.

It should be appreciated that the reinforcement wraps 1002, 1004, 1006, 1008 and 1010, and the preform inserts 1012, 1014 and 1016 may be coupled together in any suitable manner (e.g., by stitching, or the like), and in any sequence suitable for forming the preform structure 1000 exemplarily described above. Constructed as described above, exterior surfaces of the preform structure 1000 include a preform termination surface 1022, a radially-facing inner surface 1020, a radially-facing outer surface 1026, a second axially-facing surface 1028, a transition surface 1030, and an inclined surface 1032. Upon providing the ceramic matrix material to, for example, infiltrate the preform structure 1000, the attachment termination surface 126, radially-facing inner surface 108, radially-facing outer surface 110, second axially-facing surface 114, transition surface 122 and mating surface 124 can be formed to generally correspond to the preform termination surface 1022, a radially-facing inner surface 1020, a radially-facing outer surface 1026, a second axially-facing surface 1028, a transition surface 1030, and an inclined surface 1032, respectively.

Figure 11:
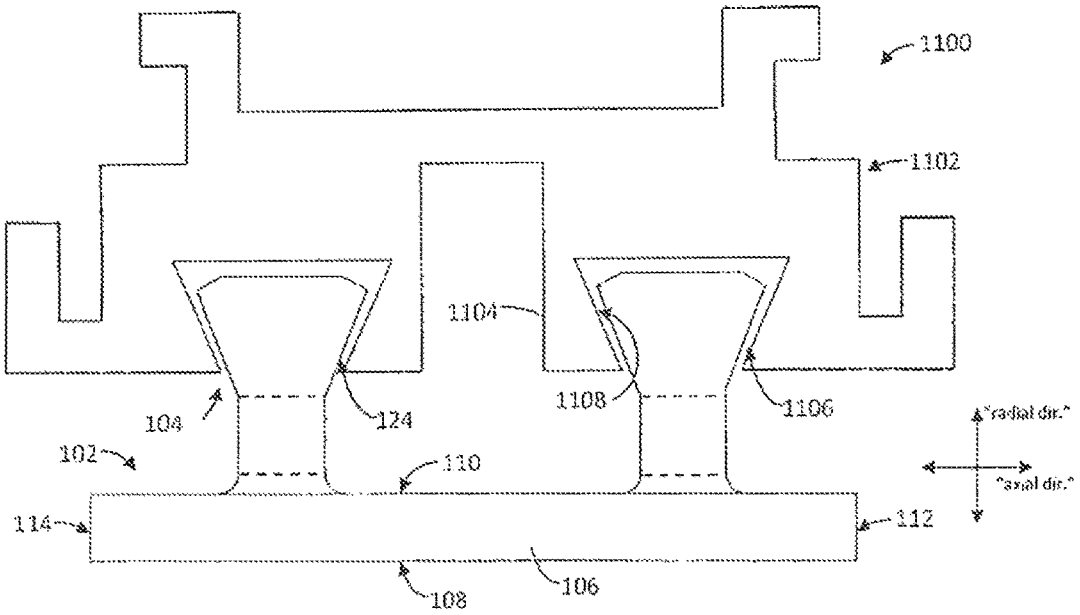
FIG. 11 is an elevational view of one embodiment of a blade track assembly including the blade track shown in FIG. 1, as shown somewhat schematically in a circumferential viewing direction.
Figure 12:
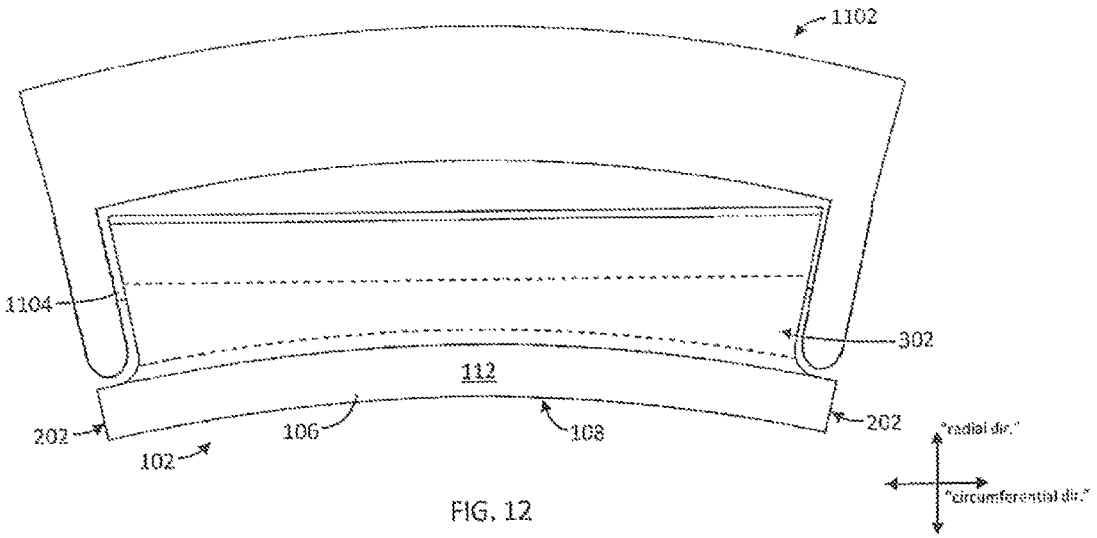
FIG. 12 is an elevational view of the blade track assembly illustrated in FIG. 11, as shown somewhat schematically in an axial viewing direction.

Referring collectively to FIGS. 11 and 12, a blade track assembly 1100 includes a hanger 1102 coupled to a blade track, such as the blade track illustrated and described above with regard to FIGS. 1 and 3. It will nevertheless be appreciated that the blade track assembly may include any blade track having an attachment portion according to any embodiment, or combination thereof, exemplarily described above.

The hanger 1102 may be formed of a metallic or other material as desired and is structured to be secured to a stationary object such as, for example, an engine case, a stationary mount, or the like. However, it should be understood that the hanger 1102 may also be formed from non-metallic materials such as inter-metallics, composites, and the like. The hanger 1102 includes a coupling portion 1104 defining a number of recesses 1106. Each recess 1106 is configured to receive an attachment portion such as, for example, the attachment portion 104. In one embodiment, each recess 1106 includes a pair of axially-opposed mating surfaces 1108 configured to engage adjacent mating surfaces of the attachment portion 104 so that the attachment portion 104 may be trapped or captured within the recess 1106 along the radial and axial directions. In one embodiment, the coupling portion 1104 can be structured such that the recess 1106 is open adjacent at least one circumferential side so that the attachment portion 104 can be inserted into the recess 1106 in a circumferential direction. As shown in FIG. 12, a portion of the hanger 1102 has been removed to reveal the attachment portion 302 adjacent the first axially-facing surface 112 of the segment body 106, which is illustrated as being positioned in front of a coupling portion 1104 coupled to another attachment portion 302 adjacent the opposite second axially-facing surface 114.

Figure 13:
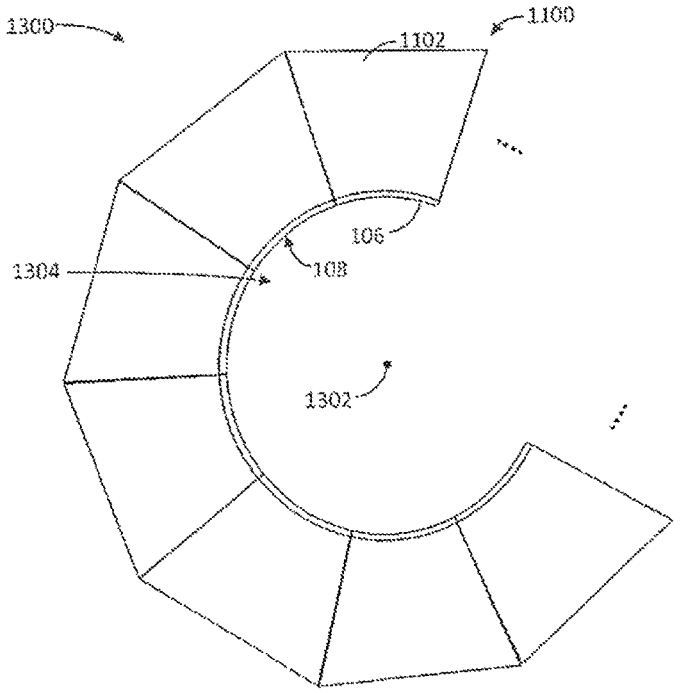
FIG. 13 is an elevational view of one embodiment of a partially-constructed turbine engine blade track assembly, as shown somewhat schematically in an axial viewing direction.

FIG. 13 is an elevation view, taken in an axial direction, illustrating a partially-constructed turbine engine blade track assembly 1300 according to one embodiment. The turbine engine blade track assembly 1300 includes a plurality of blade track assemblies 1100 arranged such that the radially-facing inner surface 108 of a segment body 106 in each blade track assembly 1100 is axially and circumferentially aligned with an adjacent blade track assembly 1100. Accordingly, the arc-shaped radially-facing inner surfaces 108 of the blade track assemblies 1100 can be arranged circumferentially about an axial flow engine axis 1302 to define a gas flow path 1304. Although not shown, a rotary turbine having a plurality of rotary turbine blades can be disposed within the gas flow path 1304 so as to be rotatable about the axial flow engine axis 1302. Radially-facing outer tips of the rotary turbine blades can abut or otherwise be positioned closely adjacent the radially-facing inner surfaces 108 of the blade track assemblies 1100. A clearance between the tips of the rotary turbine blades and the radially-facing inner surfaces 108 can be selected to enhance the operating efficiency of the gas turbine engine.

In one aspect of the present disclosure an apparatus includes a blade track including a segment portion having a first surface and a second surface opposite the first surface, wherein the first surface is arcuate; and an attachment portion extending from the second surface, wherein a coupling region of the attachment portion has a dovetail shaped cross section. The attachment portion and the segment portion of the blade track may be formed from a ceramic matrix composite material with a preform structure comprising at least one reinforcement wrap positioned around shaped ceramic fibers with at least one ply of reinforcement material, and a ceramic matrix material infiltration into the preform.

The attachment portion can include a plurality of attachment portions, wherein each attachment portion includes a coupling region with a dovetail shaped cross section. A second attachment portion extending from the second surface can include an open channel with a substantially C-shaped cross section. A hanger having a coupling portion can be structured to receive the coupling region of a corresponding attachment portion of the blade track. The hanger and the blade track can have different coefficients of thermal expansion in exemplary embodiments of the present disclosure. A plurality of blade track segments can be arranged circumferentially about a common axis to define an exhaust gas flow path for a turbine.

Another aspect of the present disclosure includes a turbine blade track assembly comprising a blade track segment portion having a first surface, a second surface opposite the first surface, and a pair of spaced apart third surfaces extending from the first surface to the second surface, wherein the first surface is an arcuate surface adapted to form a portion of an outer wall of an exhaust gas flow path; a blade track attachment portion extending from the second surface, wherein a coupling region of the attachment has a dovetail shaped cross section; and a blade track hanger configured to connect to fixed structure positioned in a gas turbine engine, the hanger having a coupling portion structured to receive the dovetail shaped coupling region of the blade track attachment portion. The components of the blade track assembly can be made from the same material or alternatively from different materials as desired.

Yet another aspect of the present disclosure includes a gas turbine engine comprising a turbine section having at least one turbine rotor with a plurality of turbine blades; a plurality of blade tracks positioned circumferentially around the turbine blades; at least one dovetail shaped connecting member extending radially outward from each blade track; and a hanger connected to a structural member of the gas turbine engine and configured to releasably couple with the at least one dovetail shaped connecting member of a corresponding blade track. The blade track can be formed from a ceramic matrix composite material and the hanger can be formed from a metallic material in one form of the disclosure.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a blade track including a segment portion comprising ceramic matrix composite materials and having a first radially-facing surface and a second radially-facing surface opposite the first radially-facing surface, wherein the first radially-facing surface is arcuate;

a first attachment portion comprising ceramic matrix composite materials and extending radially outward from the second surface and circumferentially between a first circumferentially-facing surface and a second circumferentially-facing surface opposite the first circumferentially-facing surface, wherein a coupling region of the first attachment portion has a dovetail shaped cross section, and a second attachment portion comprising ceramic matrix composite materials and extending radially outward from the second surface and circumferentially between a third circumferentially-facing surface and a fourth circumferentially-facing surface opposite the third circumferentially-facing surface, wherein a coupling region of the second attachment portion has a dovetail shaped cross section, wherein the second attachment portion is spaced apart axially from the first attachment portion, and wherein the ceramic matrix composite materials of the second attachment portion include a first reinforcement wrap, a second reinforcement wrap, a third reinforcement wrap, a fourth reinforcement wrap, a first preform insert, and a second preform insert, the first reinforcement wrap and the second reinforcement wrap are positioned adjacent one another, first end portions of the first reinforcement wrap and the second reinforcement wrap are spaced apart from one another, the first preform insert is positioned between the spaced apart first end portions of the first reinforcement wrap and the second reinforcement wrap, the third reinforcement wrap and the fourth reinforcement wrap are positioned adjacent one another, first end portions of the third reinforcement wrap and the fourth reinforcement wrap are spaced apart from one another, and the second preform insert is positioned between the spaced apart first end portions of the third reinforcement wrap and the fourth reinforcement wrap.

2. The apparatus of claim 1, further comprising:

a pair of spaced apart radially-extending third surfaces extending from the first radially-facing surface to the second radially-facing surface of the segment portion, wherein a distance from one of the radially-extending third surfaces to the first attachment portion along the axial direction is substantially the same as a distance from the other of the radially-extending third surfaces to the first attachment portion along the axial direction.

3. The apparatus of claim 1, further comprising:

a hanger having a coupling portion structured to receive the coupling region of a corresponding attachment portion of the blade track.

4. The apparatus of claim 3, wherein the hanger and the blade track have different coefficients of thermal expansion.

5. The apparatus of claim 3, wherein a plurality of blade track segments are arranged circumferentially about a common axis to define an exhaust gas flow path for a turbine.

6. The gas turbine engine of claim 1, wherein the first end portion of the second reinforcement wrap is positioned adjacent the first end portion of the fourth reinforcement wrap and the first end portions of the first reinforcement wrap and the third reinforcement wrap diverge away from one another.

7. The gas turbine engine of claim 6, wherein the ceramic matrix composite materials of the segment portion include a fifth reinforcement wrap and a third preform insert, second ends of the first and second reinforcement wraps extend away from second ends of the third and fourth reinforcement wraps, the third preform insert is positioned between a portion of the second and fourth reinforcement wraps, and the fifth reinforcement wrap is positioned adjacent the second and fourth reinforcement wraps and the third preform insert.

8. A turbine blade track assembly comprising:

a blade track segment portion having a first surface, a second surface opposite the first surface, and a pair of spaced apart third surfaces extending from the first surface to the second surface, wherein the first surface is an arcuate surface adapted to form a portion of an outer wall of an exhaust gas flow path;

a first blade track attachment portion extending radially from the second surface and circumferentially toward the third surfaces and a second blade track attachment portion extending radially from the second surface and circumferentially toward the third surfaces, the first attachment portion being axially spaced apart from the second attachment portion, wherein a coupling region of the first blade track attachment portion has a dovetail shaped cross section and a coupling region of the second blade track attachment portion has an open channel with a substantially C-shaped cross section; and a blade track hanger configured to connect to a fixed structure positioned in a gas turbine engine, the hanger having a coupling portion structured to receive the dovetail shaped coupling region of the first blade track attachment portion, wherein the first blade track attachment portion includes ceramic matrix composite materials including a first reinforcement wrap, a second reinforcement wrap, and a first preform insert, the first reinforcement wrap and the second reinforcement wrap are positioned adjacent one another, first end portions of the first reinforcement wrap and the second reinforcement wrap are spaced apart from one another, and the first preform insert is positioned between the spaced apart first end portions of the first reinforcement wrap and the second reinforcement wrap.

9. The turbine blade track assembly of claim 8, wherein a width of the first blade track attachment portion along the axial direction is greater than half a length of the segment portion from one of the third surfaces to the other of the third surfaces.

10. The turbine blade track assembly of claim 8, wherein a coefficient of thermal expansion of the blade track is different from a coefficient of thermal expansion of the hanger.

11. The turbine blade track assembly of claim 8, wherein the hanger is formed of a metallic material.

12. The turbine blade track assembly of claim 8, wherein the blade track segment and the attachment portions are formed from a ceramic matrix composite material.

13. The gas turbine engine of claim 8, wherein the ceramic matrix composite materials included in the first blade track attachment portion further include a third reinforcement wrap, a fourth reinforcement wrap, and a second preform insert, the third reinforcement wrap and the fourth reinforcement wrap are positioned adjacent one another, first end portions of the third reinforcement wrap and the fourth reinforcement wrap are spaced apart from one another, and the second preform insert is positioned between the spaced apart first end portions of the third reinforcement wrap and the fourth reinforcement wrap.

14. The gas turbine engine of claim 13, wherein the first end portion of the second reinforcement wrap is positioned adjacent the first end portion of the fourth reinforcement wrap and the first end portions of the first reinforcement wrap and the third reinforcement wrap diverge away from one another.

15. The gas turbine engine of claim 14, wherein the blade track segment portion includes ceramic matrix composite materials including a fifth reinforcement wrap and a third preform insert, second ends of the first and second reinforcement wraps extend away from second ends of the third and fourth reinforcement wraps, the third preform insert is positioned between a portion of the second and fourth reinforcement wraps, and the fifth reinforcement wrap is positioned adjacent the second and fourth reinforcement wraps and the third preform insert.

16. A gas turbine engine comprising:

a turbine section having at least one turbine rotor with a plurality of turbine blades;

a plurality of blade tracks positioned circumferentially around the turbine blades;

a plurality of dovetail shaped connecting members extending in the circumferential direction and extending radially outward from each blade track, the plurality of dovetail shaped connecting members being axially spaced apart from one another; and a hanger connected to a structural member of the gas turbine engine and configured to releasably couple with the dovetail shaped connecting members of a corresponding blade track, wherein one of the plurality of dovetail shaped connecting members includes ceramic matrix composite materials including a first reinforcement wrap, a second reinforcement wrap, and a first preform insert, the first reinforcement wrap and the second reinforcement wrap are positioned adjacent one another, first end portions of the first reinforcement wrap and the second reinforcement wrap are spaced apart from one another, and the first preform insert is positioned between the spaced apart first end portions of the first reinforcement wrap and the second reinforcement wrap.

17. The gas turbine engine of claim 16, wherein the hanger is made from a metallic material.

18. The gas turbine engine of claim 16, wherein the ceramic matrix composite materials included in the one of the plurality of dovetail shaped connecting members further include a third reinforcement wrap, a fourth reinforcement wrap, and a second preform insert, the third reinforcement wrap and the fourth reinforcement wrap are positioned adjacent one another, first end portions of the third reinforcement wrap and the fourth reinforcement wrap are spaced apart from one another, and the second preform insert is positioned between the spaced apart first end portions of the third reinforcement wrap and the fourth reinforcement wrap.

19. The gas turbine engine of claim 18, wherein the first end portion of the second reinforcement wrap is positioned adjacent the first end portion of the fourth reinforcement wrap and the first end portions of the first reinforcement wrap and the third reinforcement wrap diverge away from one another.

20. The gas turbine engine of claim 19, wherein one of the plurality of blade tracks include ceramic matrix composite materials including a fifth reinforcement wrap and a third preform insert, second ends of the first and second reinforcement wraps extend away from second ends of the third and fourth reinforcement wraps, the third preform insert is positioned between a portion of the second and fourth reinforcement wraps, and the fifth reinforcement wrap is positioned adjacent the second and fourth reinforcement wraps and the third preform insert.

* * * * *